US006136149A

United States Patent [19]

Vallius

[11] Patent Number: 6,136,149

[45] Date of Patent: Oct. 24, 2000

[54] PRESS SECTION IN A PAPER MACHINE AND METHOD FOR REPLACING PRESS FABRICS THEREIN

[75] Inventor: Oiva Vallius, Jyväskylä, Finland

[73] Assignee: Valmet Corporation, Finland

[21] Appl. No.: 09/299,515

[22] Filed: Apr. 26, 1999

[30] Foreign Application Priority Data

Apr. 28, 1998 [FI] Finland ..... 980929

[51] Int. Cl.[7] ..... D21F 1/32

[52] U.S. Cl. ..... 162/199; 162/272; 162/273; 162/274; 162/360.2

[58] Field of Search ..... 162/199, 272, 162/273, 274, 360.2

[56] References Cited

U.S. PATENT DOCUMENTS

| | | | |
|---|---|---|---|
| 4,452,668 | 6/1984 | Vallius | 162/199 |
| 4,608,125 | 8/1986 | Autio | 162/273 |
| 4,922,990 | 5/1990 | Snellman et al. | 162/273 |
| 5,091,056 | 2/1992 | Autio | 162/360.1 |
| 5,535,670 | 7/1996 | Schiel | 100/153 |

FOREIGN PATENT DOCUMENTS

| | | | |
|---|---|---|---|
| 83979 | 3/1989 | Finland | D21F 3/00 |

*Primary Examiner*—Peter Chin
*Assistant Examiner*—Mark Halpern
*Attorney, Agent, or Firm*—Steinberg & Raskin, P.C.

[57] ABSTRACT

Press section in a paper machine and method for replacing press fabrics therein including two separate press nips and a frame part for each press nip. Side frames of both frame parts are interconnected by upper horizontal beams in the machine direction. The upper horizontal beam at the tending side is comprised of two beam parts of which one is situated above the side frames of the frame part of the first nip at the tending side and the other is situated above the side frames of the frame part of the second nip at the tending side. The tending-side beam parts operate as a machine-direction cantilever beam so that a first beam part is supported on the second beam part and thereby on its frame part while the side frames of the first frame part are open for replacement of the fabrics in the first nip. The beam parts operate reciprocally with each other in inverse functions as a cantilever beam and as a support part when the press fabrics in the second nip are being replaced.

19 Claims, 6 Drawing Sheets

10
P
10W
35
17K
11
17k
NP1
35
19
16k
36
17k
29
27k
20
21
DV1
35
NP2
35
20
20
27K
S
21

16k
19
29
10
10W
P
38a
37
11
38
36
NP1
10R
20
21
DV2
20R
NP2
39
S

PRESS SECTION IN A PAPER MACHINE AND METHOD FOR REPLACING PRESS FABRICS THEREIN

FIELD OF THE INVENTION

The present invention relates to a press section in a paper machine comprising two separate press nips or groups of nips and a frame part of its own for each of the separate press nips and/or groups of nips. The frame parts comprise side frames at the driving side and at the tending side of the machine. The side frames are interconnected, e.g., by cross-direction beams. At the tending side, the side frames are provided with openable and closable intermediate pieces, which can be opened in order to replace the press fabrics in the press section so that a new press fabric or fabrics can be passed into its/their place as a closed loop through the tending side.

The present invention also relates to a method for replacing the press fabrics in a press section in a paper machine comprising two separate press nips or groups of nips, and which press section is provided with a frame part of its own for each of the separate press nips and/or groups of nips. The frame parts comprise side frames at the driving side and at the tending side of the machine. The side frames are connected, e.g., with cross-direction beams, and at the tending side, the side frames are provided with openable and closable intermediate pieces, which are opened in order to replace the press fabrics in the press section so that a new press fabric or fabrics can be passed into its/their place as a closed loop through the tending side.

BACKGROUND OF THE INVENTION

In the prior art, press sections are provided with frame parts such that the press fabrics can be removed and replaced by a new press fabric or fabrics as a closed loop. The frame parts must also be constructed so that, when necessary, the press rolls can be replaced and the different devices and components can be serviced without unreasonable work or disassembly of the machine.

As known in the prior art, the vertical frame parts at the tending side of the machine are provided with openable intermediate pieces, through which opened gaps the new press fabrics can be passed into their place as a closed loop. When the side frames at the tending side are opened, the frame part must be supported by means of an overhang, i.e., cantilevered, which takes place by the intermediate of a projecting part of the cross-direction beams of the frame part, which projecting parts extend to the driving side of the machine. These projecting parts are typically supported by means of draw bars or equivalent on the wall or floor constructions of the paper machine hall or on the base constructions of the press section on the lower parts of another frame part. The cross-direction projecting parts must be constructed to be quite long, and therefore they occupy a considerable space at the driving side of the machine. This requirement of space is increased further in view of the fact that the projecting parts have to be positioned with a very dense spacing and as an extension of almost every cross-direction beam at the driving side of the machine. This space would be necessary for the drive gears of the rolls in the press section and for devices for conditioning of the different fabrics and for other, similar devices. As an example of the prior art described above, reference is made to U.S. Pat. No. 5,535,670 assigned as issuance to J. M. Voith GmbH.

The numerous prior art cantilever beams which extend to the tending side of the machine divide the space provided at the driving side alongside the machine into small compartments, in which it is difficult to place and to service the drive gears of the press section and other devices and systems that are otherwise particularly suitable for these spaces.

The replacement of press rolls usually takes place so that the press rolls are shifted by means of a crane in the axial direction to the tending side of the machine while supporting the press rolls from their axle journals and possibly from between the axle journals by means of an overhead crane mounted on the ceiling. The current assignee has also constructed press sections in which free spaces can be opened above the press rolls by pivoting or otherwise shifting the frame parts, and through this space, it is possible to replace a press roll or rolls by lifting the same straight or substantially straight upwards and by introducing the new roll by means of the same procedure and along the same route into the place of the removed roll(s). With respect to the last-mentioned arrangements for replacement of press rolls and fabrics, reference is made to the current assignee's U.S. Pat. Nos. 4,452,668 and 4,608,125, incorporated by reference herein.

The cantilever arrangement described above results in considerable drawbacks, which are emphasized further in press sections in which separate nips or groups of nips are employed. These drawbacks are manifested with particular emphasis in press sections that comprise two separate extended nips, which press section is marketed by the current assignee under the trade mark SymBeltPress II™. As known in the prior art, the frame system of this press section comprises two frame parts of substantially equal shape, which frame parts are interconnected from above by means of machine-direction upper beams in order to increase the rigidity of the frame.

OBJECTS AND SUMMARY OF THE INVENTION

Accordingly, it is an object of the present invention to provide a press section with frame system for a paper machine and a method for replacing fabrics in which the drawbacks discussed above do not occur.

It is another object of the present invention to provide new and improved press sections and method for replacing fabrics therein.

It is a particular object of the present invention to provide a press section with frame system and a method for replacing fabrics by whose means an increased space is obtained at the driving side for different drive gears and for other, similar devices and for devices for conditioning of the different fabrics and for servicing of the various devices.

It is still another object of the present invention to provide a press section with frame system for a paper machine and a method for replacing fabrics in which the cross-direction tilting caused in the frame systems by the draw bars used in prior art cantilevering arrangements can be eliminated or reduced in conditions of operation.

In view of achieving one or more of the objects stated above, and others, one embodiment of a press section in accordance with the invention comprises frame parts having side frames which are interconnected by means of upper horizontal beams in the machine direction and the upper horizontal beam at the tending side is comprised of two beam parts, of which a first beam part is situated above the side frames of the first nip or group of nips at the tending side, and a second beam part is placed above the side frames of the latter frame part at the tending side. The tending-side beam parts are interconnected so that they operate as a machine-direction cantilever beam whereby the first beam part is supported on the second beam part and, through it, on the frame part associated with the second beam part while the side frames of the frame part associated with the first beam part are opened for replacement of the fabric or fabrics in the first nip and/or group of nips. Thus, the beam parts operate reciprocally with each other in inverse functions as a cantilever beam and as a support part when the press fabric or fabrics in the latter nip or group of nips is/are being replaced.

In the method in accordance with the invention for replacing press fabrics, for cantilevering of the frame part of the press, an upper horizontal beam of the frame part at the tending side is employed, at which upper horizontal beam the former beam part is supported by means of the frame part of the latter nip or group of nips when the fabric or fabrics of the former press nip or group of nips is/are being replaced, and at which upper horizontal beam the latter beam part is supported by means of the former frame part when the press fabric or fabrics of the latter nip or group of nips is/are being replaced.

In accordance with the invention, an upper horizontal machine-direction beam at the tending side of the frame system of the press is employed as a cantilever beam so that, alternatingly, it is possible to open the tending-side side frames of the first or the second press or of an equivalent group of nips for the purpose of replacing the fabrics and possibly also of a press roll or rolls in the press concerned. In this manner, one upper horizontal beam part is supported on the side frames of one press and that the other upper horizontal beam part is employed as a cantilever support beam. The fabric or fabrics in the other press or group of nips can be replaced by using the different component beams of the upper horizontal beam reciprocally as a cantilever part and as a support part in functions that have been reversed between the beam parts. In such a case, the cantilevering of the cross-direction beams of the frame system at the driving side can be made less massive, and the projecting portion of the cross-direction beams can be made shorter, and in this manner, additional space can be provided at the driving side for various drive gears and other devices, such as felt conditioning devices.

In the present invention, the cantilever beams at the driving side, which beams are substantially shorter than corresponding prior art cantilever parts, can, if necessary, be provided with draw bars or with corresponding supports (as if often the case for wider machines) on the other hand, in narrower machines, in a press frame arrangement and in a method in accordance with the invention, the cantilevering can be carried out without sets of draw bars or equivalent support arrangements at the driving side, which increases the free space at the driving side further, which free space can be taken to the effective useful use described above.

One particular advantage of the arrangements described above is that the cross-direction tilting caused by the draw bars in the frame system in conditions of operation is eliminated. In the frame system in accordance with the present invention, the loading takes place on the base plate at the tending side and at the driving side substantially in the same direction. In the present invention, an increased overall rigidity is obtained for the frame system so that the side frame systems of the pick-up roll are coupled with the parts placed underneath.

Thus, a press section in a paper machine in accordance with the invention includes at least first and second separate press nips arranged in first and second frame parts, respectively, each frame parts comprising side frames at the driving side and tending side, cross-direction beams for connecting the side frames at the driving side to aligning side frames at the tending side, and intermediate pieces arranged between the side frames at the tending side and being removable to enable adjacent side frames to separate from one another. A first horizontal beam connects the side frames of the first frame part to the side frames of the second frame part at the driving side. The first horizontal beam is oriented in the machine direction. A second horizontal beam connects the side frames of the first frame part to the side frames of the second frame part at the tending side and is also oriented in the machine direction. The second horizontal beam comprises first and second beam parts, the first beam part being arranged above the side frames of the first frame part at the tending side and the second beam part being arranged above the side frames of the second frame part at the tending side. The first and second beam parts are coupled to one another to constitute a machine-direction cantilever beam wherein the first beam part is supportable on the second beam part and thus on the second frame part while the side frames of the first frame part at the tending side are open for replacement of a fabric in the first nip and the second beam part is supportable on the first beam part and thus on the first frame part while the side frames of the second frame part at the tending side are open for replacement of a fabric in the second nip. The first and second frame parts have substantially the same overall shape. The first and second press nips may be extended-nip presses defined by a shoe roll provided with a hose mantle and a rigid-mantle press roll, and arranged substantially in a middle area of the first and second frame parts, respectively, in the machine direction.

In some embodiments, at least some of the cross-direction beams include a projecting part extending from the driving side in a direction away from the tending side, and at least one machine-direction beam is provided for connecting at least two horizontally adjacent projecting parts together. Additionally or alternatively, at least one vertical beam may be provided for connecting at least two vertically adjacent projecting parts together. A cantilever draw bar may also be coupled to the projecting part for supporting the projecting part on a base construction of the press section.

The first and second beam parts of the second horizontal beam have opposed sides being pivotally connected to one another to enable the intermediate pieces arranged between the side frames of one of the first and second frame parts to be opened while the intermediate pieces arranged between the side frames of the other frame part remain in place. To this end, an articulation shaft may be connected to the first and second beam parts, and a hydraulic cylinder connected at one end to the first beam part and at a second end to the second beam part to enable pivotal movement of the first beam part about the articulation shaft while the second beam part is stationary and vice versa. Instead of a pivotal connection, the first and second beam parts may be vertically displaceable relative to one another about the opposed sides to enable the intermediate pieces arranged between the side frames of one of the first and second frame parts to be opened while the intermediate pieces arranged between the side frames of the other frame part remain in place. In this case, pin joints connect the first beam part to the second beam part.

A method for replacing press fabrics in a press section in a paper machine comprises the steps of arranging the first and second press nips in first and second frame parts, respectively, each frame part comprising side frames at the driving side and tending side, connecting the side frames at the driving side to aligning ones of the side frames at the tending side, arranging openable intermediate pieces between the side frames at the tending side, arranging a first beam part of a horizontal beam above the side frames of the first frame part at the tending side, and arranging a second beam part of the horizontal beam above the side frames of the second frame part at the tending side, the first and second beam parts being movable with respect to one another. When replacing one of the press fabrics in the first press nip, the intermediate pieces between the side frames of the first frame part are opened to enable adjacent ones of the side frames to separate from one another, the first frame part is supported on the second frame part, and the press fabric is changed as a closed loop. On the other hand, when replacing one of the press fabrics in the second press nip, the intermediate pieces between the side frames of the second frame part are opened to enable adjacent ones of the side frames to separate from one another, the second frame part is supported on the first frame part, and the press fabric is changed as a closed loop. Supporting one frame part on the other may entail pivoting the beam part associated with the frame part around an articulation shaft while the other beam part remains supported on the side frames. In the alternative, one beam part is linearly shifted (e.g., vertically upward) relative to the other beam part which remains supported on the side frames.

In the following, the invention will be described in detail with reference to some preferred exemplifying embodiments of the invention illustrated in the figures in the accompanying drawing. However, the invention is by no means strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
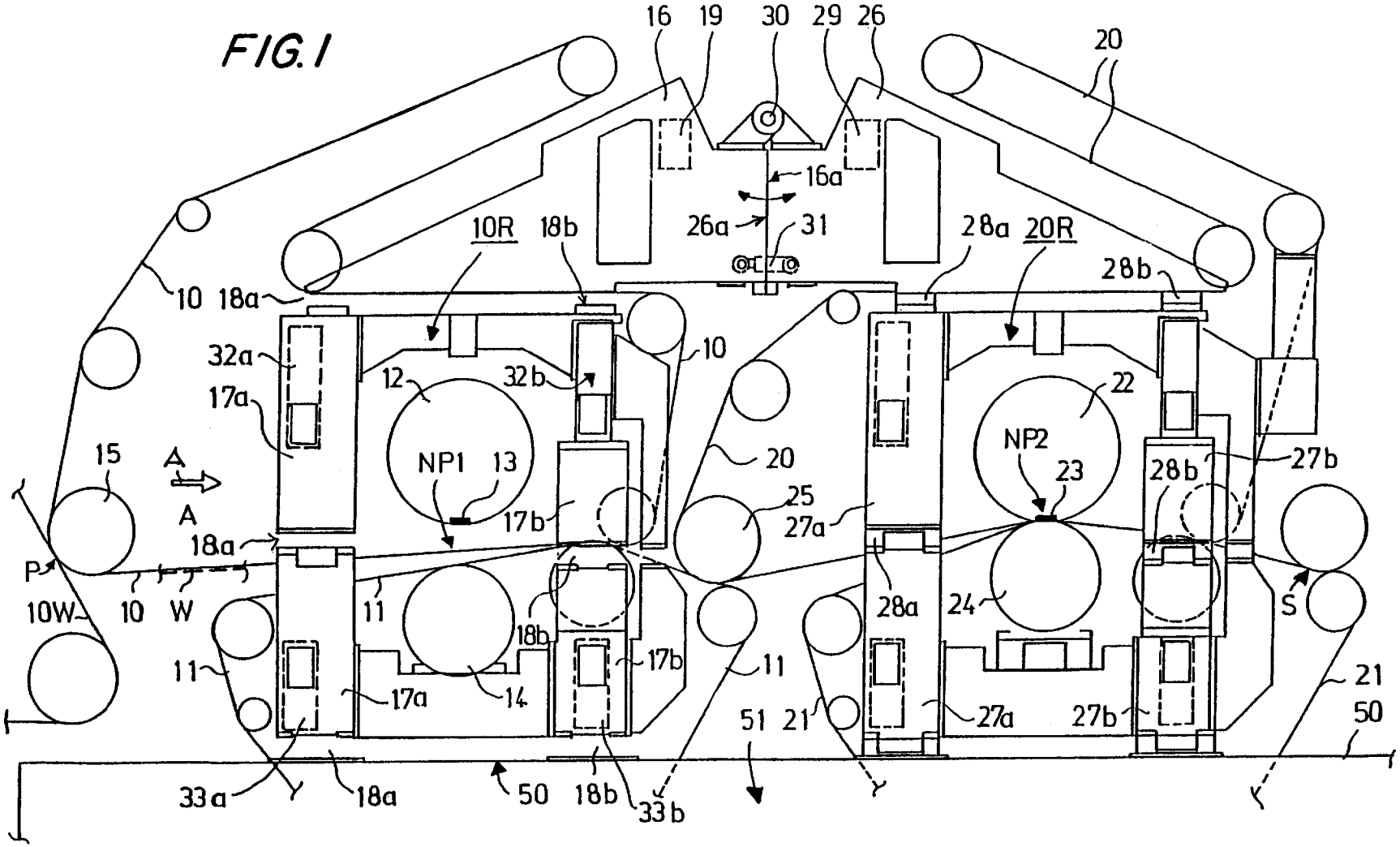
FIG. 1 is a side view from the tending side of a frame system of a press section in accordance with a first embodiment of the invention in a situation in which the first extended nip in the press section and the frame system of this nip are open for replacement of the fabrics of the first extended nip, while the second extended nip and its frame system are in a closed position.

Referring to the accompanying drawings wherein the same reference numerals refer to the same or similar elements, the press section shown in FIGS. 1–5 comprises two separate extended nips $NP_1$ and $NP_2$. The first of these extended nips $NP_1$ and $NP_2$ is formed between an upper shoe roll 12 provided with a hose mantle and a lower hollow-faced press roll 14. The shoe roll 12 is provided with a series of press shoes 13 in itself known, by means of which shoes 13, the necessary nip load is produced in the extended-nip zone against the backup roll 14. A paper web W is transferred from a forming wire 10W of the former preceding the press section at the pick-up point P about a suction roll 15 onto an upper press fabric 10 running into and through the first nip $NP_1$. The web W is passed on the lower face of the fabric 10 into and through the first nip $NP_1$. In the first nip $NP_1$, there is also a lower fabric 11 which carries the web W after the first nip $NP_1$ as a closed draw onto an upper fabric 20 running into and through the second nip $NP_2$. The web W is transferred onto fabric 20 in a suction zone of a transfer suction roll 25 situated in a loop of fabric 20. The second nip $NP_2$ is formed between a shoe roll 23 provided with a hose mantle and a series of press shoes 23 and a lower hollow-faced press roll 24. A second, lower press fabric 21 also runs into and through the second nip $NP_2$, which fabric 21 carries the web W as a closed draw to a transfer point S at which the web W is transferred further onto the drying wire (not shown) of the dryer section following after the press section.

In the press section shown in FIGS. 1–5, there are two separate extended nips $NP_1$ and $NP_2$, but at this stage it must already be emphasized that the frame system in accordance with the present invention for a press can also be applied in press sections in which one or both of the extended nips $NP_1$ and $NP_2$ has/have been substituted by a roll nip or by a combination of roll nips. It is essential that the press section includes at least two separate nips and/or groups of nips, each of which has a separate frame system or frame part 10R and 20R of its own. The frame system in accordance with the invention for a press section is particularly well suitable expressly for a press in which there are two successive separate extended nips, each of which is provided with two press fabrics and between which nips the web has a closed draw. This type of press section is marketed by the current assignee under the trade mark SymBeltPress II™.

In the following, the construction and operation of the frame system illustrated in FIGS. 1–6 will be described in particular in respect of replacement of press fabrics.

As shown in FIGS. 1–5, the first extended nip $NP_1$ is in the opened position, and side frames 17*a*, 17*b* at a tending side H of the frame part 10R of the first press are also in the open position. In such a case, the intermediate pieces of the side frames 17*a*, 17*b* have been opened and/or removed, so that there are open intermediate spaces 18*a*, 18*b* in the side frame system at the tending side H, through which spaces the press fabrics 10, 11 can be removed as closed loops through the tending side H. Similarly, as shown in FIGS. 1–5, the frame part 20R of the second press is in the closed position, in which case, intermediate pieces 28*a*, 28*b* of the side frames 27*a*, 27*b* are in their place and close the side frames 27*a*, 27*b*. The frame parts 10R, 20R of the separate nips $NP_1$, $NP_2$ are preferably of substantially equal shape, so that the whole frame system is substantially symmetrical in relation to the cross-direction vertical plane that runs through an articulation shaft 30 of upper horizontal beams 16, 26.

When the frame part 10R of the first nip $NP_1$ is in the open position in the manner shown in FIGS. 1–5, the machine-direction upper beam 16 placed above the frame part 10R is cantilevered, i.e., overhang-supported, on the corresponding upper beam 26 placed above the second frame part 20R. The upper frame beams 16, 26 are connected by means of cross-direction beams 19, 29, with a corresponding frame part 16*k* at the driving side, which frame part 16*k* is continuous in the machine direction. The frame beams 16, 26 are interconnected at their opposite vertical sides 16*a*, 26*a* by means of the upper cross-direction articulation shaft 30. In the lower part of the sides 16*a*, 26*a*, there is a hydraulic cylinder 31 or an equivalent power unit, by whose means the frame part 16 is pivoted upwards and supported so that the intermediate spaces 18*a*, 18*b* can be opened. In connection with the intermediate pieces 28*a*, 28*b*, there are hydraulic power units in themselves known, by whose means the opening and the shifting away of the intermediate pieces 28*a*, 28*b* is carried out so that the free spaces are opened in the side frames 27*a*, 27*b* for removal of the fabrics 20, 21. In a similar manner, although not shown, there are intermediate pieces for side frames 17*a*, 17*b* and in connection therewith, there are hydraulic power units in themselves known, by whose means the opening and the shifting away of these intermediate pieces is carried out so that the free spaces 18*a*, 18*b* are opened in the side frames 17*a*, 17*b* for removal of the fabrics 10, 11. When the fabrics 10, 11 or 20, 21 are being removed, the respective nip $NP_1$ or $NP_2$ must be in the opened position. The rolls 12, 14; 22, 24 of the nips $NP_1$ and $NP_2$ are removed in a way in itself known to the tending side so that the rolls are supported, e.g., from their axle journals by means of an upper crane mounted on the ceiling and by shifting the rolls in the axial direction to the tending side H.

In the method in accordance with the invention for replacing of the press fabrics 10, 11 and 20, 21 and in the construction of the frame system of the press, both frame parts 10R, 20R cannot be opened at the same time, but the parts 16, 26 of the upper horizontal beam operate alternatingly and reciprocally as a support beam and as a cantilever beam for the cantilevering.

When the press fabric loops 20 and 21 of the second press nip $NP_2$ are being removed, the second nip $NP_2$ is in the open position corresponding to the position of the first nip $NP_1$ shown in FIGS. 1–5, whereas the first nip $NP_1$ is in the closed position and whereas the frame part 10R of the first nip $NP_1$ is in the closed position in a corresponding manner so that the intermediate spaces 18*a*, 18*b* of the side frames 17*a*, 17*b* are closed, and the intermediate pieces 28*a*, 28*b* of the side frames 27*a*, 27*b* of the frame 20R of the second nip $NP_2$ are in the opened position. In such a case, the upper frame beam 26 is cantilevered on the upper frame beam 16 and, by means of the hydraulic cylinder 31, the upper frame 26 can be raised and supported while the side frames 27*a*, 27*b* are in the opened position for removal of the fabrics 20 and 21 of the nip $NP_2$. Thus, the overhang supporting or cantilevering of the upper frame beams 16, 26 of the frame parts 10R, 20R of the first and second press can be carried out alternatingly while using the machine-direction upper frame beams 16, 26 as a cantilever beam with support on the side frames 17*a*, 17*b*; 27*a*, 27*b*.

In the embodiment illustrated in FIGS. 1–5, when the first frame part 10R is in the opened position for removal of the fabrics 10, 11 of the first press, the weight of the upper beam 16 is supported, by the intermediate of the upper beam 26 connected with the upper beam 16, on the vertical frames 27*a*, 27*b* so that the weight produces a compression strain on the vertical frame 27*a* and a tensile strain on the vertical frame 27*b*.

Figure 2:
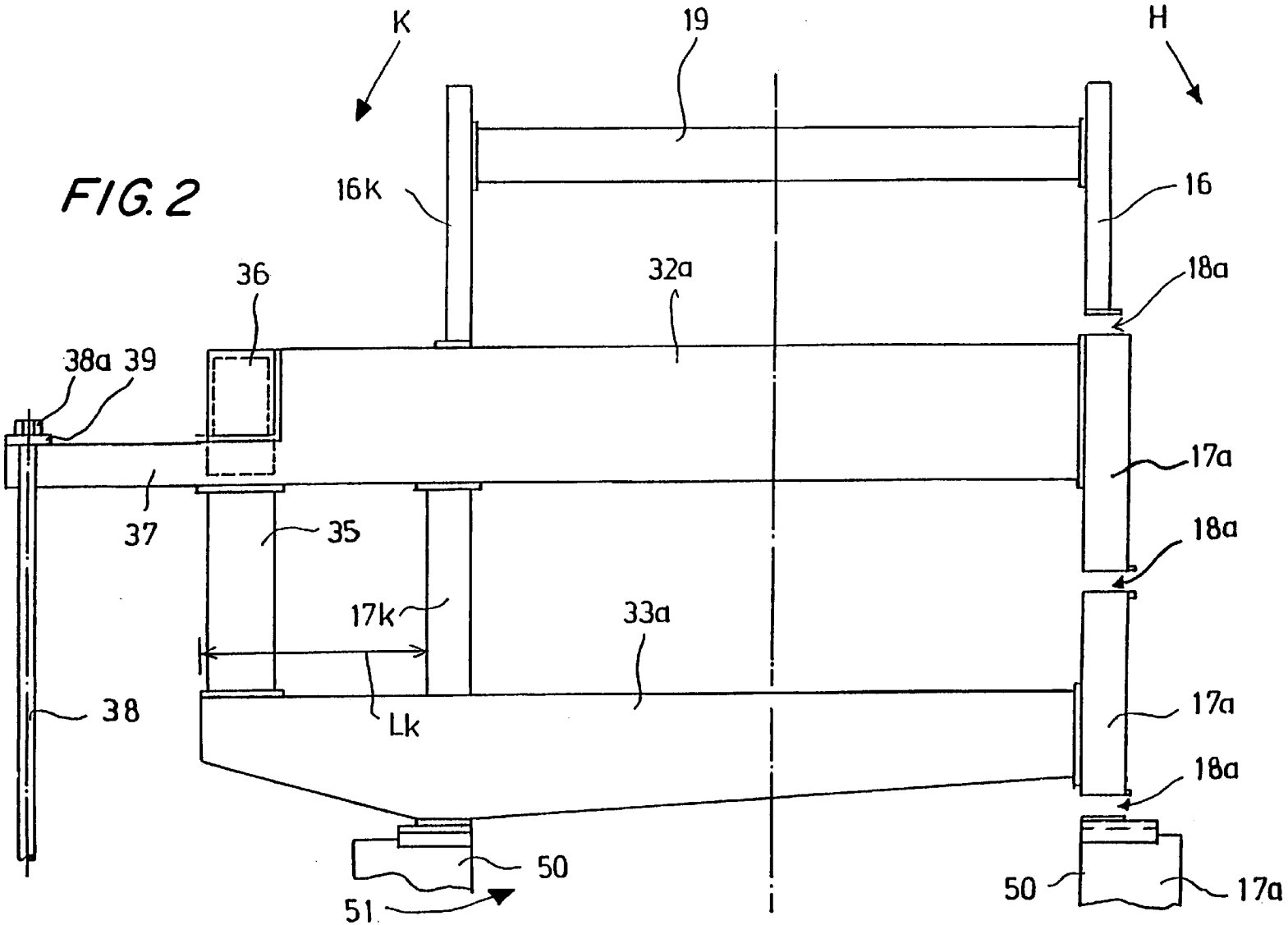
FIG. 2 shows the frame system as shown in FIG. 1 as viewed in the machine direction indicated in FIG. 1 with the arrow A.
Figure 4:
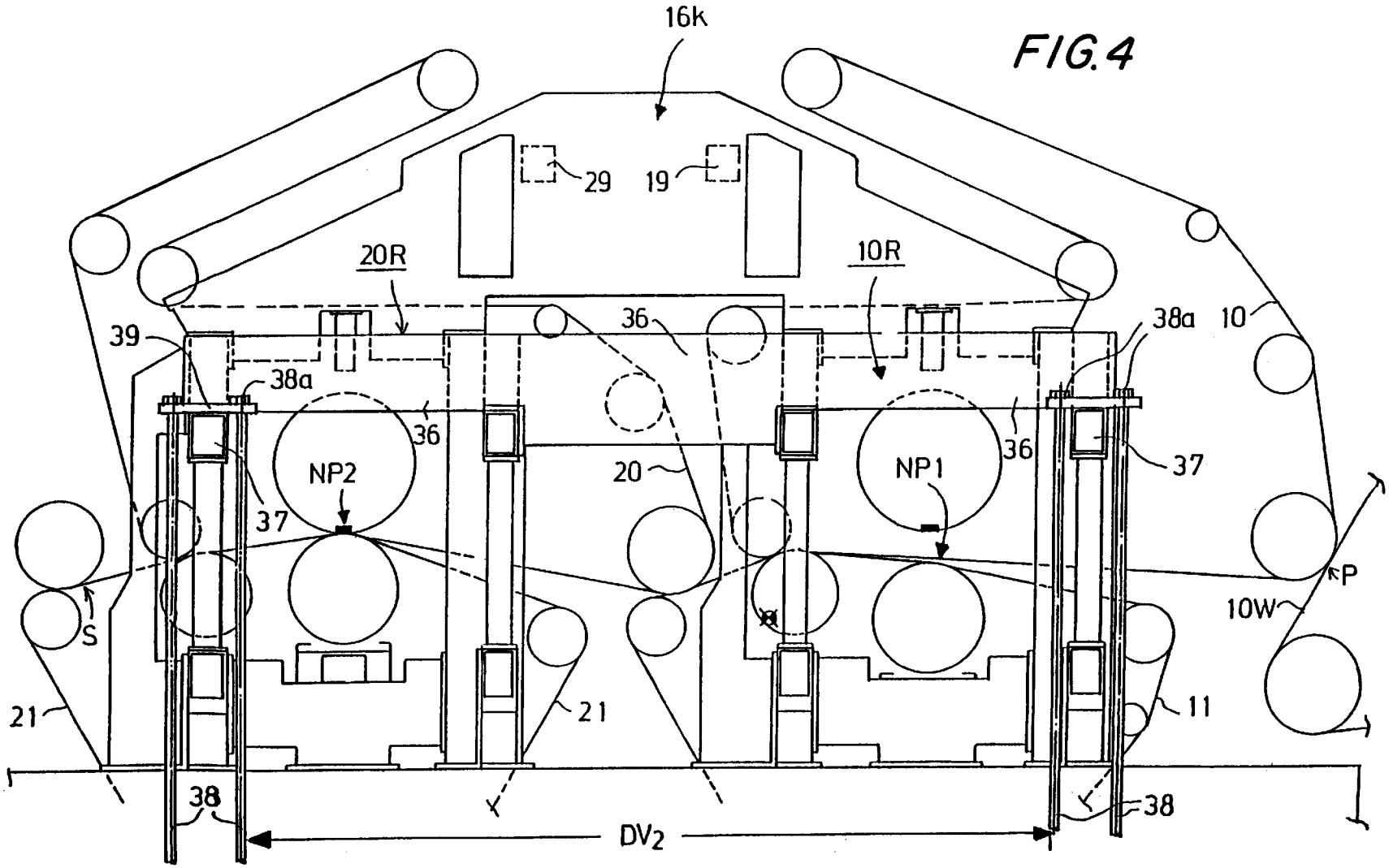
FIG. 4 is an illustration corresponding to FIG. 3 of an exemplifying embodiment of the invention in which the draw bars shown in FIG. 2 are used for cantilevering, as viewed from the driving side.

As shown most clearly in FIGS. 1 and 2, the side frames 17*a* of the press section at the 20 tending side H have been connected with the side frames 16*k*, 17*k* at the driving side K by means of cross-direction beams 32*a*, 33*a*; 32*b*, 33*b*. These beams 32*a*, 33*a*; 32*b*, 33*b* are cantilever beams which are interconnected by a machine-direction horizontal upper beam 36 and by vertical beams 35. As shown in FIGS. 2 and 4, the cross-direction beams 32*a*, 33*a*; 32*b*, 33*b* are overhang-supported by binding them together by means of vertical beams 35 and by means of the horizontal upper beam 36 and by making use of the projecting part 37 at the driving side K of the upper cross-direction beam 32*a*, 32*b*. This projecting part 37 is supported by means of pairs of draw bars 38 on the base constructions 50 of the paper machine hall, below which there is the basement space 51. As also shown in FIGS. 2 and 4, a fastening flange 39 is at the top end of the pairs of draw bars 38 and is supported against the top side of the projecting part 37. The draw bars 38 are connected with the projecting part 37 by means of the fastening flange 39 and by means of screw connections 38*a*.

Figure 3:
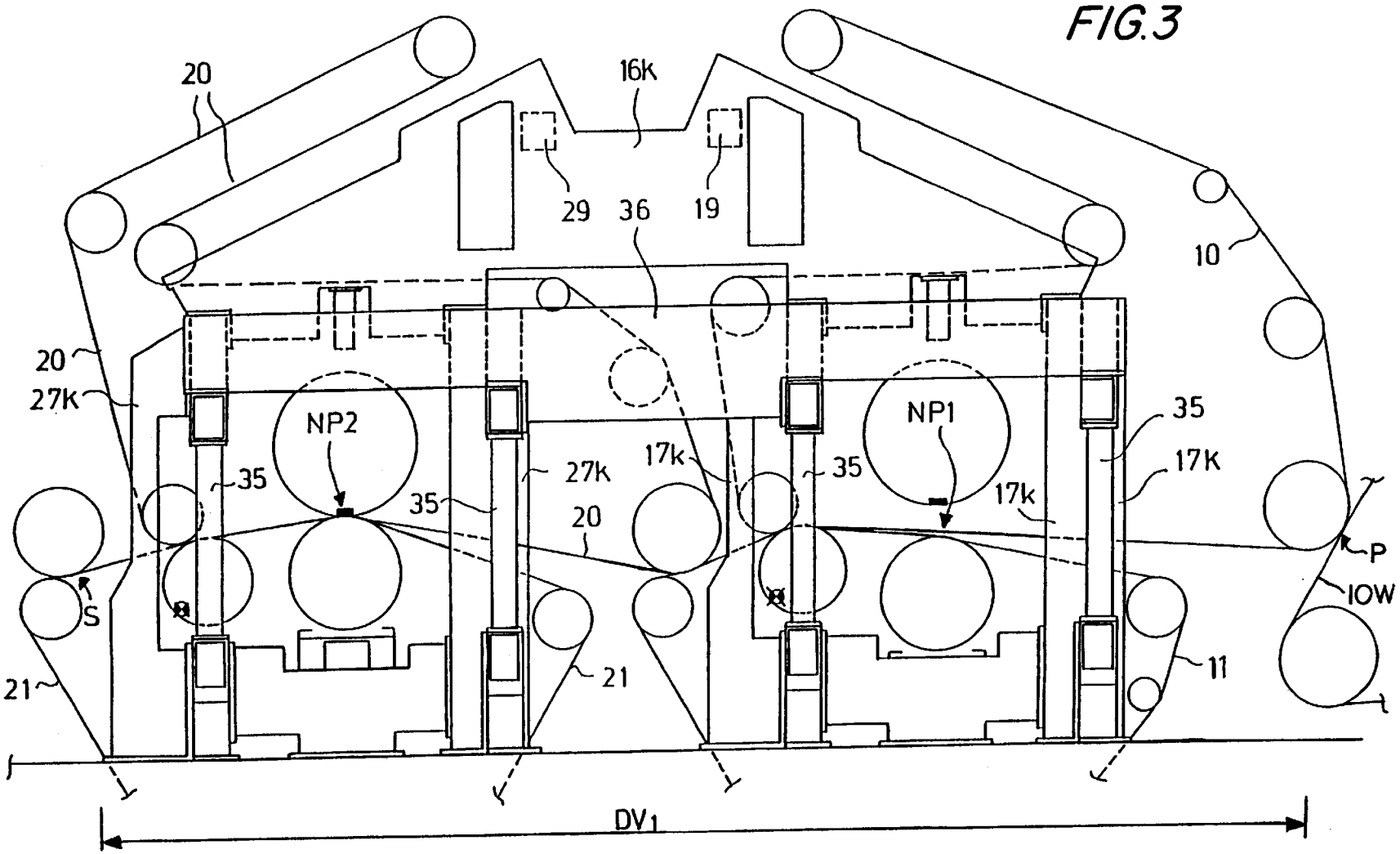
FIG. 3 illustrates the press section and its frame system as shown in FIGS. 1 and 2, as viewed from the driving side of the machine, i.e., from the opposite side in relation to FIG. 1.

As shown in FIG. 3, the press frame system can also be accomplished without a projecting part 37 and without a set of draw bars 38. When a set of draw bars 38 is used, between the draw bars, at the driving side K of the machine, a free space $DV_2$ remains for the drive gear of the press section and for other systems placed at the driving side. A space $DV_1$, which is longer than the space $DV_2$, remains at the driving side K, extending from the pick-up point P to the transfer point S over the entire length of the press section in the machine direction. A frame system as shown in FIG. 3 is employed, most typically, in narrower machines, whereas a frame system as shown in FIGS. 2 and 4, in which cantilever draw bars 38 are employed, is better suitable for wider machines.

Referring again to FIG. 2, when a projecting part 37 and a set of drawbars 38 are used, or also without them, an extension $L_K$ of the cross-direction beams 32*a*, 33*a* outside the side frames 16*k*, 17*k* at the driving side K of the machine is considerably shorter than in the prior art press frames, in which machine-direction cantilevering of the upper beams 16, 26 at the tending side in accordance with the invention has not been used. This extension $L_K$ is usually about 40% to about 45% shorter than in the prior art cantilevered press sections provided with cross-direction cantilever beams, which increases the free space at the driving side K of the press section to a substantial extent, which free space is needed for various drive gears and drive systems.

Figure 5:
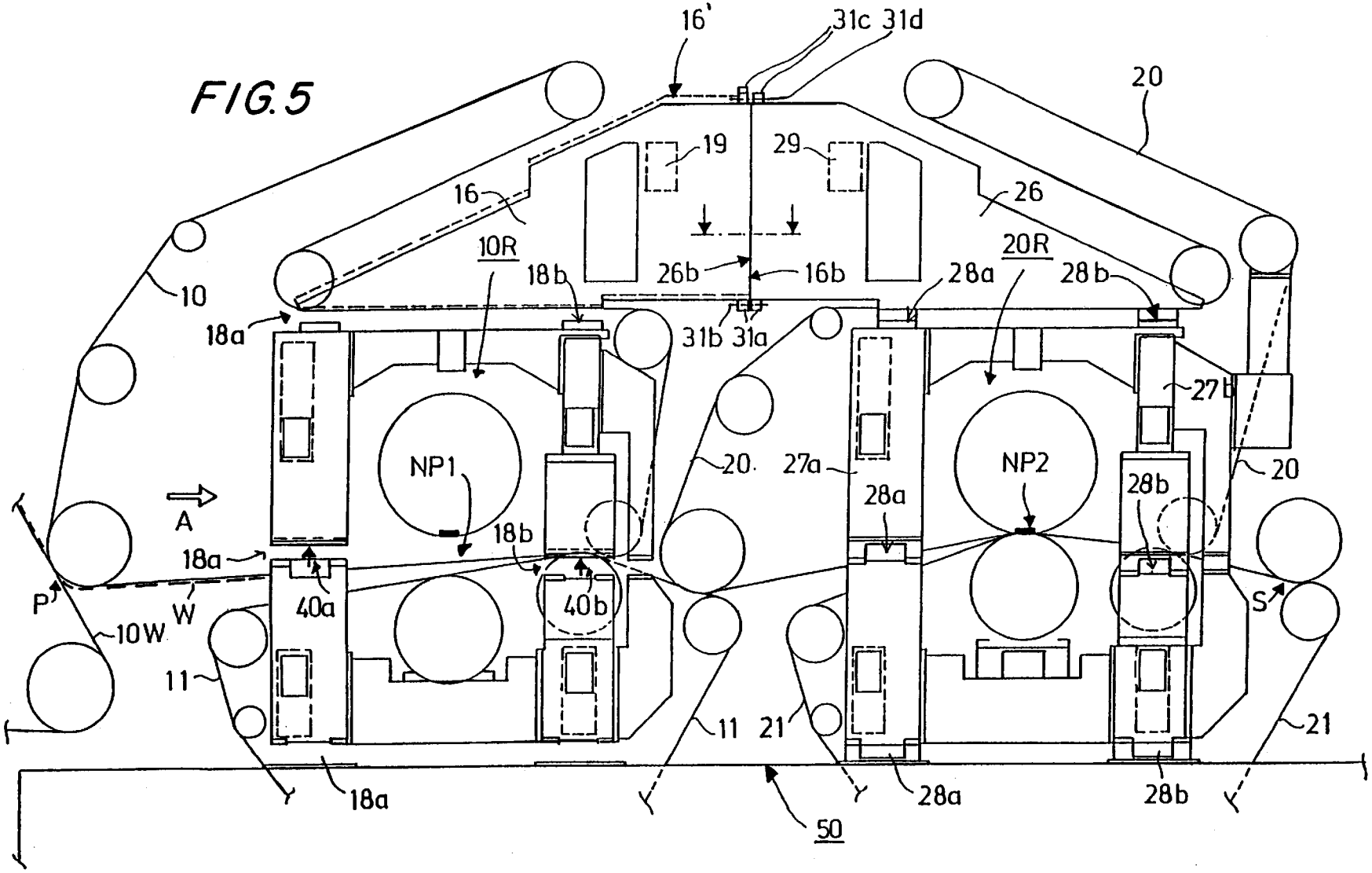
FIG. 5 is an illustration corresponding to FIG. 1 of a second embodiment of the invention.
Figure 6:
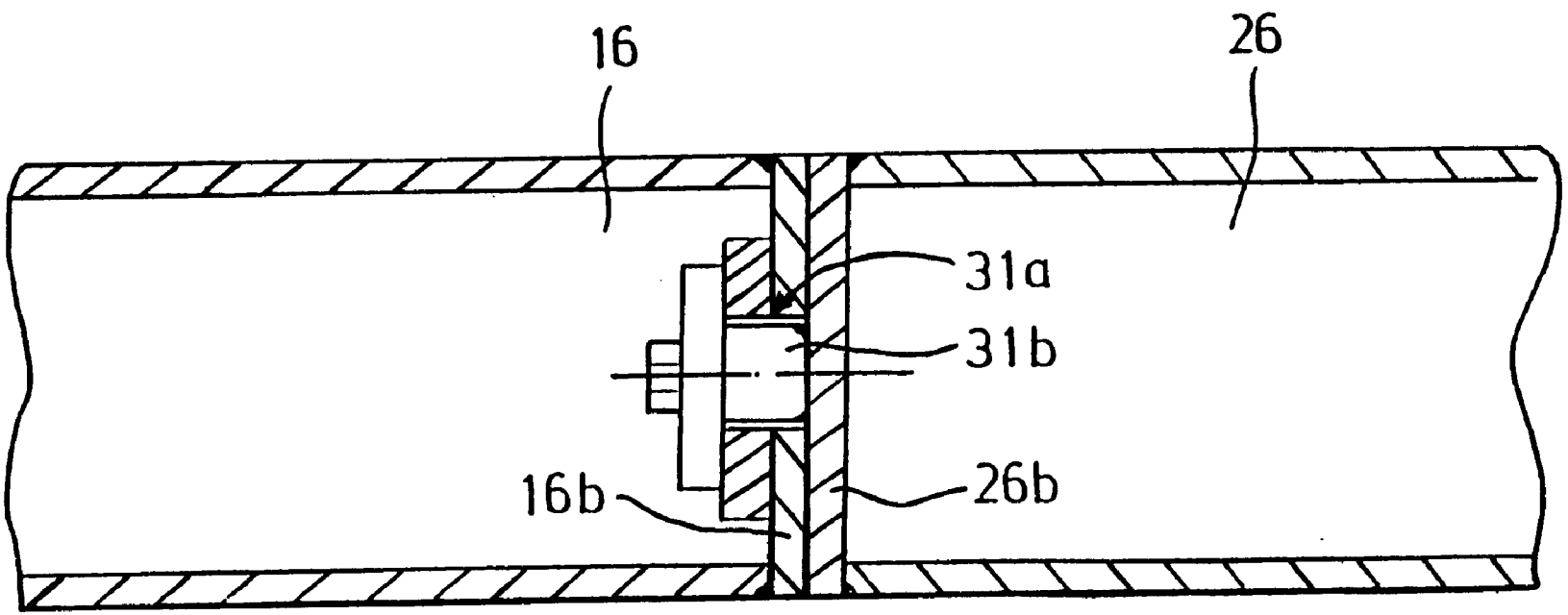
FIG. 6 is a horizontal sectional view taken along the line 6—6 in FIG. 5.

FIGS. 5 and 6 show an alternative embodiment of the coupling between the upper beams 16, 26 as shown in FIG. 1. In this embodiment, the sides 16*b*, 26*b* of the upper beams 16, 26 placed one against the other can be interconnected by means of pin joints 31*a*, 31*b*; 31*c*, 31*d* placed at the top and at the bottom of the beams. As shown in FIG. 5, when the frame part 10R of the first nip $NP_1$ is open and when the intermediate pieces 18*a*,18*b* are still closed, the upper beam 16 is shifted by means of power units 40*a*, 40*b* to the upper position 16'. For this shifting, the pin joints 31*a*, 31*b*; 31*c*, 31*d* shown in FIGS. 5 and 6 are opened, and, when the upper beam 16 has been shifted to the upper position 16', the pin joints 31*a*, 31*b*; 31*c*, 31*d* are fixed in the closed position. In such a case, the upper beam 16 is cantilever-supported on the upper beam 26 and on the side frames 27*a*, 27*b*. Similarly, when the fabric loops 20, 21 of the second nip $NP_2$ are being removed, the upper beam 26 is cantilever-supported on the upper beam 16, in which connection, the upper beam 26 is thus raised to an upper position (not shown) corresponding to the position 16'.

As shown in FIGS. 1 and 5, as viewed from the side, the horizontal upper beams 16, 26 and 16*k* have a substantially triangular shape and are symmetrical in relation to the vertical cross-direction plane passing through the opposite ends 16*a*, 26*a* of the beam parts 16, 26, the top side of the substantially triangular shape being inclined from the middle part downwards. In such a case, the upper runs of the loops of the upper fabrics 10, 20 will be placed slightly above the top sides of the beams 16, 26, 16*k*, in which case, the fabric 10, 20 conditioning devices (not shown) can be placed favorably in the vicinity of the top sides of the beam 16, 26, 16*k*. In this manner, a particularly compact frame construction is provided, which has even a reasonable height so that the frame can be made rigid and stable so that its tendency of vibration is low.

In the following, the patent claims will be given, and the different details of the invention may show variation within the scope of the inventive idea defined in the patent claims and differ from the exemplifying embodiments described above. Thus, the examples provided above are not meant to be exclusive. Many other variations of the present invention would be obvious to those skilled in the art, and are contemplated to be within the scope of the appended claims.

I claim:

1. A press section in a paper machine having a driving side, a tending side and a machine direction, comprising:

at least first and second separate press nips, first and second frame parts, said first and second nips being arranged in said first and second frame parts, respectively, each of said first and second frame parts comprising side frames at the driving side and tending side, cross-direction beams for connecting said side frames at the driving side to aligning ones of said side frames at the tending side, and intermediate pieces arranged between said side frames at the tending side and being openable to enable adjacent ones of said side frames to separate from one another; p1 a first horizontal beam for connecting said side frames of said first frame part to said side frames of said second frame part at the driving side, said first horizontal beam being oriented in the machine direction, and a second horizontal beam for connecting said side frames of said first frame part to said side frames of said second frame part at the tending side, said second beam being oriented in the machine direction and comprising first and second beam parts, said first beam part being arranged above said side frames of said first frame part at the tending side and said second beam part being arranged above said side frames of said second frame part at the tending side, said first and second beam parts being coupled to one another to constitute a machine-direction cantilever beam wherein said first beam part is supportable on said second beam part and thus on said second frame part while said side frames of said first frame part at the tending side are open for replacement of a fabric in said first nip and said second beam part is supportable on said first beam part and thus on said first frame part while said side frames of said second frame part at the tending side are open for replacement of a fabric in said second nip.

2. The press section of claim 1, wherein said first and second frame parts have substantially the same shape.

3. The press section of claim 1, wherein said first and second press nips are extended-nip presses defined by a shoe roll provided with a hose mantle and a rigid-mantle press roll.

4. The press section of claim 1, wherein said first and second press nips are arranged substantially in a middle area of said first and second frame parts, respectively, in the machine direction.

5. The press section of claim 1, wherein at least some of said cross-direction beams include a projecting part extending from the driving side in a direction away from the tending side, further comprising:

at least one machine-direction beam for connecting at least two horizontally adjacent ones of said projecting parts together.

6. The press section of claim 1, wherein at least some of said cross-direction beams include a projecting part extending from the driving side in a direction away from the tending side, further comprising at least one vertical beam for connecting at least two vertically adjacent one of said projecting parts together.

7. The press section of claim 1, wherein at least one of said cross-direction beams includes a projecting part, further comprising at least one cantilever draw bar coupled to said projecting part for supporting said projecting part on a base construction of the press section.

8. The press section of claim 1, wherein said first horizontal beam is substantially triangular and said first and second beam parts are substantially triangular.

9. The press section of claim 1, further comprising:

horizontal cross-direction beams for connecting said first horizontal beam to said first and second beam parts of said second horizontal beam.

10. The press section of claim 1, wherein said first and second beam parts of said second horizontal beam have opposed sides, said opposed sides being pivotally connected to one another to enable said intermediate pieces arranged between said side frames of one of said first and second frame parts to be opened while said intermediate pieces arranged between said side frames of the other of said first and second frame parts remain in place.

11. The press section of claim 10, further comprising:

an articulation shaft connected to said first and second beam parts, and a hydraulic cylinder having a first end connected to said first beam part and a second end connected to said second beam part to enable pivotal movement of said first beam part about said articulation shaft while said second beam part is stationary and vice versa.

12. The press section of claim 1, wherein said first and second beam parts of said second horizontal beam have opposed sides, said first beam part being vertically displaceable relative to said second beam part about said opposed sides to enable said intermediate pieces arranged between said side frames of one of said first and second frame parts to be opened while said intermediate pieces arranged between said side frames of the other of said first and second frame parts remain in place.

13. The press section of claim 12, further comprising pin joints connecting said first beam part to said second beam part.

14. A method for replacing press fabrics in a press section in a paper machine having a driving side, a tending side, a machine direction, at least first and second separate press nips, comprising the steps of:

arranging the first and second press nips in first and second frame parts, respectively, each of the first and second frame parts comprising side frames at the driving side and tending side, connecting the side frames at the driving side to aligning ones of the side frames at the tending side, arranging openable intermediate pieces between the side frames at the tending side, arranging a first beam part of a horizontal beam above the side frames of the first frame part at the tending side, arranging a second beam part of the horizontal beam above the side frames of the second frame part at the tending side, said first and second beam parts being movable with respect to one another, and when replacing one of the press fabrics in the first press nip, opening the intermediate pieces between the side frames of the first frame part to enable adjacent ones of the side frames to separate from one another, supporting the first frame part on the second frame part, and changing the press fabric as a closed loop; and when replacing one of the press fabrics in the second press nip, opening the intermediate pieces between the side frames of the second frame part to enable adjacent ones of the side frames to separate from one another, supporting the second frame part on the first frame part, and changing the press fabric as a closed loop.

15. The method of claim 14, wherein the step of supporting one of the first and second frame parts on the other of the first and second frame parts comprising the step of pivoting the one of the first and second beam parts around an articulation shaft while the other of said first and second beam parts remains supported on the side frames.

16. The method of claim 14, wherein the step of supporting one of the first and second frame parts on the other of the first and second frame parts comprising the step of linearly shifting the one of the first and second beam parts relative to the other of said first and second beam parts which remains supported on the side frames.

17. The method of claim 14, wherein the side frames at the driving side are connected to aligning ones of the side frames at the tending side by means of cross-direction beams.

18. The method of claim 17, further comprising the step of:

supporting the cross-direction beams on each other at ends of projecting parts at the driving side by means of at least one of horizontal beams and vertical beams.

19. The method of claim 18, further comprising the step of:

supporting the cross-direction beams on each other at ends of projecting parts at the driving side by means of at least one of horizontal beams, vertical beams and draw bars.

* * * * *